US005937539A

United States Patent [19]

Takahashi

[11] Patent Number: 5,937,539

[45] Date of Patent: Aug. 17, 1999

[54] DUAL-PURPOSE COMBUSTER FOR ORDINARY COMBUSTION AND PULSE COMBUSTION

[75] Inventor: Masashi Takahashi, Yokihoma, Japan

[73] Assignee: Powdering Japan K.K., Tokyo, Japan

[21] Appl. No.: 08/969,661

[22] Filed: Nov. 13, 1997

[30] Foreign Application Priority Data

Jun. 19, 1997 [JP] Japan ..... 9-162561

[51] Int. Cl.[6] ..... F26B 21/06

[52] U.S. Cl. ..... 34/191

[58] Field of Search ..... 34/279, 365, 373, 34/379, 479, 77, 84, 86, 102, 592, 169, 191, 210, 219, 579, 585; 432/14–17, 27, 96, 137; 110/224; 431/1, 114

[56] References Cited

U.S. PATENT DOCUMENTS 5,044,930 9/1991 Hongo et al. ..... 431/1
5,092,766 3/1992 Kubotani ..... 34/516 X
5,252,061 10/1993 Ozer et al. ..... 34/365 X
5,638,609 6/1997 Chandran et al. ..... 34/365

*Primary Examiner*—Harry Bennett
*Assistant Examiner*—Steve Garvini
*Attorney, Agent, or Firm*—Pillsbury, Madison & Sutro LLP

[57] ABSTRACT

A dual-purpose combustor for ordinary combustion and pulse combustion especially suited to be installed for a spray dryer, which is used not only as an ordinary combustion gas generator but also as a pulse combustion gas generator capable of generating high frequency sound waves and hot blast in large capacity to enhance the drying efficiency. The dual-purpose combustor is composed essentially of successionally connected chambers: a concentric narrow ring form fuel/combustion air mixed gas supply slit, a concentric wider ring form combustion chamber having an ignition means and a narrow outlet portion, a concentric narrow ring form exhaust gas chamber, a concentric wider ring form upper secondary combustion chamber, and a concentric cylindrical form lower secondary combustion chamber having the same diameter with the outer diameter of the concentric ring form upper secondary combustion chamber.

7 Claims, 5 Drawing Sheets

DUAL-PURPOSE COMBUSTER FOR ORDINARY COMBUSTION AND PULSE COMBUSTION

BACKGROUND OF THE INVENTION

1. Filed of the Invention

The present invention relates to a dual-purpose combustor for ordinary combustion and pulse combustion, especially suited to be installed on a spray dryer. The combustor is used not only as a convenient ordinary noiseless combustion gas generator but also as a pulse combustion gas generator capable of generating hot blasts and high frequency sound waves even at large capacity to keep the high drying efficiency.

2. Description of the Prior Art

Spray dryers (spray drying equipments) are widely employed in food industries, chemical industries and the like, and hot blasts from ordinary burners (LPG burners) are commonly used for their drying heat sources. Ordinary combustors are generally in box shapes (rectangular ducts) disposed in the course of drying air ducts, and have a burner at central portion of the box. Ordinary spray dryers have such an arrangement as "air intake fan→air intake duct→LPG burner→insulated air intake duct→dryer→hot blast chamber", which requires a rather wide installation space and a cost inclusive of insulated air intake duct amounting to 3–5 times more than a LPG burner cost. Further, some materials are dried insufficiently by ordinary combustion gases.

Different from ordinary combustors, pulse combustors generate pulsating high-temperature combustion gases resulting from explosive combustions on scores—several hundred cycle/second. When water-bearing raw materials are sprayed into the combustion gas, the material is subjected to physically impulsive actions (sonic waves and pressure waves) in addition to drying effects by the hot blast. As the result, since a far higher drying rate is available by comparison with the spray drying with ordinary hot blast, attention is given these years to pulse combustors as means for drying raw materials recognized as difficultly dried by conventional hot blast drying equipments.

Pulse combustors are based on the technology of jet engines, and various type of combustors have been proposed for drying of water-bearing materials. As a typical example thereof, the pulse transducer disclosed by JP-B-6-33939 will be explained hereunder by reference to FIG. 6. In the pulse transducer, the combustion chamber 3 having a narrow outlet portion 4 is connected coaxially with an exhaust gas chamber 5 enlarging gradually, and a fuel supply pipe 9, a combustion air supply pipe 10 and ignition means 41 exemplified by a sparking plug are disposed for the combustion chamber 3. When the combustion chamber is filled with air supplied through the combustion air supply pipe 10 and the fuel oil from the fuel supply pipe 9 is sprayed or gaseous fuel like LPG is charged, combustion of the fuel occurs explosively upon ignition and the resulted hot blast proceeds to the exhaust gas chamber 5. The supply of air and fuel is interrupted momentarily due to the temporary high pressure in the combustion chamber 3, but the supply of air and fuel resumes when the combustion chamber 3 turns to reduced pressure conditions caused by exhaustion of the combustion gas to the exhaust gas chamber 5, and phenomenon including the ignition, explosive combustion and blasting of exhaust gas are repeated. The intermittent blasting generates pulsating hot blast and sound waves. When a water-bearing raw material is supplied through the water-bearing raw material supply pipe 15 into the exhaust pipe 5 or supplied at outlet portion of the exhaust pipe 5, the water-bearing raw material is subjected not only to drying effect by the hot blast but also to pulsating physical impacts (sound wave force, pressure, etc.) so as to be dehydrated instantly. In the course of time for thus started pulse combustor, inside walls of the combustion chamber 3 turn to ignited states to result in eliminating ignition of the charged air and fuel with the ignition means 41, and enabling the automatic ignition thereof by contacting with the ignited inside wall to bring about repeated intermittent explosive combustions.

There are valve type combustors and valve-less type ones for pulse combustors, and the former controls the combustion by means of valves disposed at the combustion air intake and at the fuel intake both connected to the combustion chamber. The valve type combustors are able to control the explosive combustion frequency, however, frequencies of up to scores cycle/second are at the best due to the mechanical switching. The valve-less type combustors provide explosive combustion frequency of several hundred cycle/second by small scale combustors of scores thousand kcal/Hr. From the standpoint that more effective drying effects are obtainable when the frequency of explosive combustion becomes higher, valve-less type combustors are considered as superior because of their capabilities for providing higher frequencies and causing no mechanical troubles. However, valve-less type combustors have defects of lowering explosive combustion frequency and decreasing drying efficacy for larger scale combustors, due to the inversely proportional relationship between the explosive combustion frequency and volume of the combustion chamber. Further, a lowered explosive combustion frequency may cause resonance to housings for the installation.

At the price of the superior drying effect, pulse combustors generate far louder noises incomparable to ordinary hot blast drying facilities, and it is required to take sound (noise) prevention measures. From the view point of insulating noises coming from the drying facilities, since insulation of sound (noise) is easier for higher frequency sounds and quite difficult for lower frequency sounds, the maximum drying capacity of around 800,000kcal/Hr are considered as the upper limit for conventional pulse combustors. For a dryer having drying capacity of more than several million kcal/Hr, it is contemplated to dispose a number of small scale pulse combustors at top portion of the drying tower to constitute totally a large capacity drying facility, however, the facility costs too much and the piping system is too complicated. Accordingly, a pulse combustor having a large capacity and a high frequency pulse combustion is desired.

As shown in FIG. 6, when the water-bearing raw material supply pipe 15 is disposed along the central axis of the pulse combustor, the water-bearing raw material supply pipe is heated to 1200° C. or higher, and charring of raw material on inside surface of the water-bearing raw material supply pipe and on the spraying nozzle occurs to develop troubles during a long term operation or a continuous intermittent operation. Even when the water-bearing raw material supply pipe 15 is inserted in a heat insulated protecting tube and forceful blowing of outdoor air into the protecting tube is undertaken, the water-bearing raw material supply pipe cannot be cooled enough. Further, selection of construction materials for the water-bearing raw material supply pipe and heat insulated protecting tube is a problem. As shown in FIG. 7, there is a way of inserting sideward the water-bearing raw material supply pipe 15 and disposing the spraying nozzle at outlet portion of the exhaust gas chamber 5, however, troubles arise during the continuous operation due to the raw material supply pipe and spraying nozzle are heated to form charred particles adhering on surfaces of the pipe and nozzle.

There is another problem that since the allowable combustion capacity range of pulse combustors for keeping the stable pulse combustion is so narrow as around ±30% that the range required for ordinary spray dryers of above ±50% is unmanageable.

Many existing spray drying equipments are directed usually to general-use machines for drying various kinds of material, and conventional indirect hot air heating methods or continuous direct combustion air heating methods are mainly employed. Though higher drying rates are obtainable by pulse combustion gas drying methods, the high level noise generation makes only a few users agree to convert their dryers for materials manageable with ordinary hot-air drying methods to pulse combustion gas drying methods just merely for improvements in the drying efficiency, and thus pulse combustion methods have not been employed widely.

Other than the noise problem, another difficulty of pulse combustion gas drying methods for those using conventional hot-air spray dryers is that pulse combustors are unsuitable to be installed in combination with wide angle atomizing nozzles as pressurized spraying nozzles and rotary atomizers used commonly in hot blast dryers, since the pulse combustion exhaust gas is blown out with a small diameter and thus only double-fluid atomizing nozzles exhibiting narrow spraying angles are employable.

An improved drying effects obtainable by pulse combustion gas are attractive to those employing conventional hot blast spray dryers because of enabling the usage for drying of water-bearing raw materials which are recognized heretofore as impossible to be dried by spray drying methods. However, the interest by those users is almost lost when they know not only of difficulties in incorporating in existing facilities but also of noise problems and inapplicability to existing liquid atomizing equipments. The problems may be solved by facilities capable of switching the combustion methods from one method to another in accordance with the usage, however, such combustors were not manufactured. The reason is that, although it is possible for conventional pulse combustors to maintain the continuous combustion by means of reducing the air-fuel ratio (amount of air charged/theoretical amount of air necessary for complete combustion of supplied fuel) to below 0.7, a secondary combustion with long flame occurs at the outlet of exhaust pipe, and thus it is impossible for spray dryers to employ pulse combustors installed in conventional manners.

SUMMARY OF THE INVENTION

The present invention is directed to provide a dual-purpose combustor for ordinary combustion and pulse combustion being especially suited for installation in a spray dryer, which combustor can be used conveniently not only as an ordinary combustion gas generator without making noise but also as a large capacity high frequency pulse combustion gas generator, widening the narrowly restricted defective combustion ranges of pulse combustors, and further adaptable to such wide angle liquid atomizers as pressurized atomizing nozzles and rotary atomizers heretofore recognized as impossible.

The dual-purpose combustor for ordinary combustion and pulse combustion according to the present invention is composed essentially of successionally connected chambers comprising: a concentric narrow ring form fuel/combustion air mixed gas supply slit chamber, a concentric wider ring form combustion chamber having an ignition means and a narrow outlet portion, a concentric narrow ring form exhaust gas chamber, a concentric wider ring form upper secondary combustion chamber, and a cylindrical form lower secondary combustion chamber having the same diameter with the outer diameter of the concentric ring form upper secondary combustion chamber.

DESCRIPTION OF THE PREFERRED EMBODIMENTS

Figure 1:
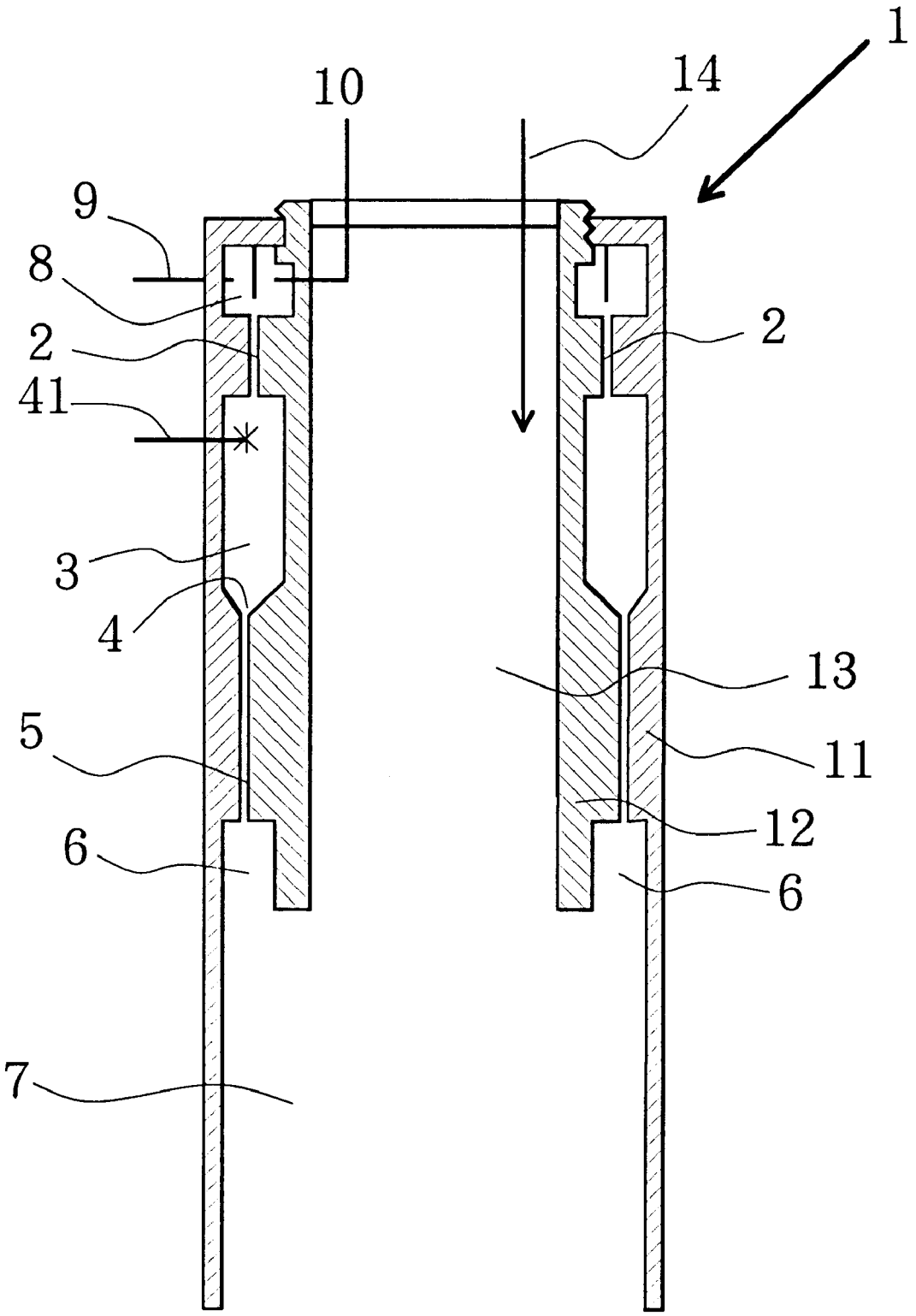
FIG. 1 is a vertical section showing fundamental constituents of the present combustor.

The constituent will be explained by reference to FIG. 1 as that the dual-purpose combustor 1 for ordinary combustion and pulse combustion according to the present invention has successional connection of: the concentric narrow ring form fuel/combustion air mixed gas supply slit 2, the concentric wider ring form combustion chamber 3 having the ignition means 41 and the narrow outlet portion 4, the concentric narrow ring form exhaust gas chamber 5, the concentric wider ring form upper secondary combustion chamber 6, and the cylindrical form lower secondary combustion chamber 7 having the same diameter with the outer diameter of the concentric ring form upper secondary combustion chamber.

A combustor having the configuration can be assembled readily by inserting the short inner cylinder 12 shown in FIG. 1 by the section into the long outer cylinder 11 shown in FIG. 1 by the section. According to this configuration for the combustor, it is possible to enlarge horizontal sectional area of the space formed between the outer cylinder and inner cylinder by shaving side surface of the outer cylinder 11 and side surface of the inner cylinder 12, and the volume of combustion chamber can be expanded to about 3 times. Expanding sectional areas of the exhaust gas chamber 5 and others can be accomplished similarly.

When the present combustor is compared with conventional pulse combustors, though both have essentially the same longitudinal section (axial section), both differ remarkably in that combustion chamber and exhaust gas chamber for conventional pulse combustors exhibit cylindrical horizontal sections in contrast to that the present combustor exhibits the concentric ring form (doughnut form) section for the combustion chamber etc., and the secondary combustion chamber is disposed below the exhaust gas chamber. In case not only of ordinary (continuous) combustion but also of pulse combustion, combustions at above the rated capacity make the complete combustion within the combustion chamber difficult, and cause blowing out of flame from the exhaust chamber. In order to shorten the afterburning flame as much as possible, the ring form upper secondary combustion chamber 6 and the cylindrical form lower secondary combustion chamber 7 are disposed. The lower secondary combustion chamber 7 has the sectional area enlarged so abruptly that the secondary combustion air forms eddy current and proceeds into the upper secondary combustion chamber to be mixed by eddy flowing, which enables the complete combustion with shortened flame.

A fuel/combustion air mixed gas is supplied through the supply slit 2, and the mixed gas having the ratio of the amount of air supplied to the theoretical amount of air for complete fuel combustion (hereinafter referred to as the supplied air amount ratio) of above 0.7, usually of 0.8–1.5, can generate a pulse combustion gas based on the principle mentioned previously. High temperature pulse combustion gas discharged from the outlet of the concentric ring form (doughnut form) exhaust gas chamber 5 is mixed with the air supplied directly to the secondary combustion chamber to become a pulse gas of proper temperature, and then discharged from the lower secondary combustion chamber 7 as a pulse gas having the wide sectional area corresponding to inner diameter of the lower secondary combustion chamber 7. Even when the supplied air amount ratio is below 1.0 (but above 0.7), since a secondary air flows back from the outlet of exhaust gas chamber into the combustion chamber in reduced pressure state after the explosive combustion, the supplied air amount ratio becomes above 1.0 at the succeeding explosion to achieve the complete combustion and no outside extension of flame occurs.

When a fuel and air mixture having supplied air amount ratio of below 0.7, usually of 0.4–0.6, is charged to the combustion chamber, the pulse combustion does not occur in the combustion chamber due to shortage of oxygen but continuous combustion occurs to generate an incomplete combustion gas to cause afterburning with flame outside of the exhaust gas chamber. Oxygen required for afterburning is supplyed by secondary air. In ordinary combustion, the secondary air acts as a source of oxygen necessary for afterburning and also as a cooling gas for cooling the combustion gas to proper temperatures. The cooled secondary combustion gas is exhausted from the lower secondary combustion chamber 7 as a gas having a proper temperature and wide sectional area corresponding to the lower secondary combustion chamber 7.

The proper temperature mentioned above is a temperature decided in accordance with thermal stability of the material to be dried. Preparations of relatively high temperature gases for high thermal stability materials by reducing the secondary air amount, and relatively low temperature gases for low thermal stability materials by increasing secondary air amount can be done readily by those skilled in the art.

Though the present combustor can be used independently as a hot air generating apparatus for spray driers, it also can be used for dual or three-way hot air generating system by combining it with existing spray dryers having indirect heating systems or ordinary direct heating systems, to generate pulse combustion gas. When only a pulse combustor is employed as the heat source of a large scale spray dryer, the unnecessarily high level noise requires excessive costs for sound insulations and resonance preventions of equipments or housings. Thus, for such large scale spray dryers, it is the most effective dual system design to have a main hot blast source of an ordinary combustion (or indirect heating) and dispose a pulse combustor capable of supplying sufficiently necessary sound level (energy) in the hot air chamber of a spray drier.

The amount of air necessary for combustion the same amount of fuel under pulse combustion or by ordinary combustion to obtain combustion gases having temperatures suitable for spray drying is the same, however, a pulse combustion proceeds when the primary air supplied to the combustion chamber has the supplied air amount ratio of above 0.7, usually of 0.8–1.5, and the rest is supplied by the secondary air, and an ordinary combustion proceeds when the primary air is so reduced as to have the supplied air amount ratio of below 0.7, usually of 0.4–0.6, and the rest is supplied by the secondary air. Selection of the pulse combustion gas drying process enabling an enhanced drying efficiency but emitting noise or the ordinary combustion gas drying process providing inferior drying efficiency but causing no noise problem may depend on kinds of material subjected to the drying, operating time (e.g. night-time), economy and the like. Accordingly, for drying various kinds of raw materials, an ordinary combustion operation during night-time and a pulse combustion operation during daytime may be contemplated.

Since combustion gases from pulse combustion or ordinary combustion of the present combustor ejects from the lower secondary combustion chamber 7 with a large diameter corresponding to inner diameter of the lower secondary combustion chamber 7, pressurized atomizing nozzles or rotary atomizers having wide spraying angles employed usually for hot blast are also usable.

In conventional pulse combustors, the fuel and combustion air are supplied to the combustion chamber separately, however, a mixed gas prepared beforehand at a specified supply air amount ratio can be charged from a slit to improve the combustion efficiency. A mixed gas having a specified supply air amount ratio prepared in a concentric ring form fuel and combustion air supply chamber 8 is supplied to the concentric ring form fuel/combustion air mixed gas supply slit 2 disposed below the gas supply chamber 8. The fuel and combustion air may either be supplied to the fuel and combustion air supply chamber 8 independently through a fuel supply pipe 9 and a combustion air supply pipe 10 to be mixed within the supply chamber 8, or be supplied to the supply chamber 8 (through the supply pipe 18) as a pre-mixed gas prepared at outside facilities in a specified supply air amount ratio. The former supply mode is shown in FIG. 1 and the latter is in FIG. 2. In general, the pre-mixed gas supply mode is preferred for small-scale combustors, and the separate supply of fuel and air to the fuel/combustion air mixed gas supply chamber is better for large-scale combustors.

Figure 2:
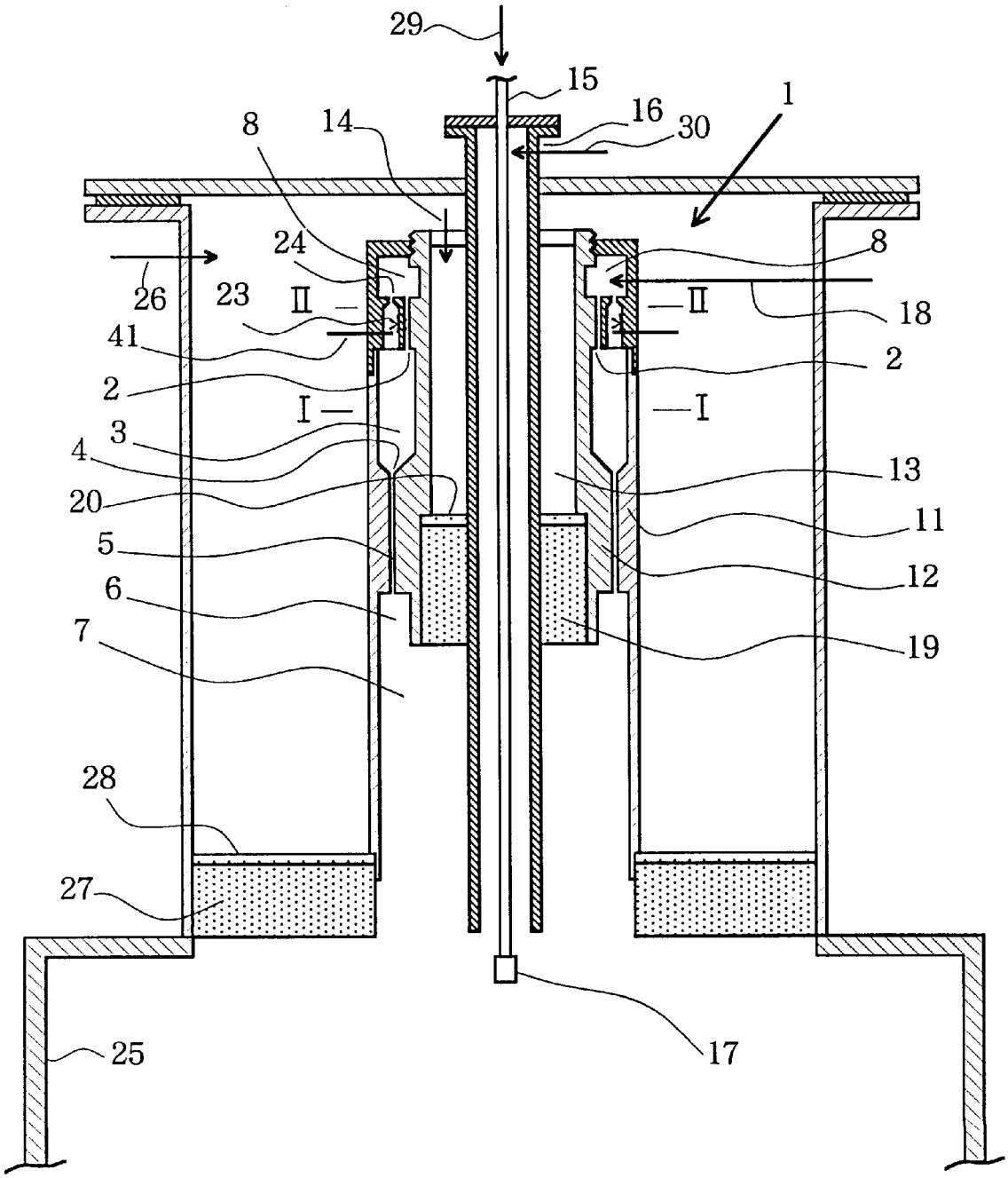
FIG. 2 is a vertical section showing an embodiment of the present combustor.

The present combustor 1 disposed at top portion of a spray drying tower 25 will be explained by use of FIG. 2. Since the fuel and combustion air supply chamber 8, slit 2, combustion chamber 3 and exhaust gas chamber 5 have respectively a concentric ring form, a cylindrical cavity 13 is formed at the central portion. A water-bearing raw material supply pipe 15 is disposed in the cavity 13 along the central axis of the concentric ring form. In FIG. 2, the water-bearing raw material supply pipe 15 accompanied by a protecting tube 16 is shown. The spray nozzle 17 is disposed at the head of the water-bearing raw material supply pipe 15. The secondary air enters from the air inlet 14 disposed at upper portion of the concentric ring form cavity formed inside of the cavity 13 but outside of the protecting tube 16, and is straightened by the honeycomb ring 19 disposed at bottom portion of the cavity, and then introduced into the lower secondary combustion chamber 7. The reference number 20 indicates a porous plate for introducing dispersed secondary air into the honeycomb ring 19, reference number 18 is a fuel and combustion air mixed gas supply pipe, reference number 29 is the water-bearing raw material, and reference number 30 is an air inlet for protecting tube. The reference number 26 is an air inlet disposed at top portion of the spray drying tower 25, and the incoming air cools the combustion chamber from outside and is heated by itself, straightened by a honeycomb ring 27 and then introduced into the spray drying tower 25. The reference number 28 is a porous plate for dispersing the air entering from the air inlet to be charge to the honeycomb ring 27.

Since the water-bearing raw material supply pipe 15 is inserted along the central axis of the cylindrical cavity 13, the water-bearing raw material can be sprayed without passing through the high temperature combustion chamber toward central portions of ordinary combustion gas or pulse combustion gas, and further, due partly to cooling effect of the secondary air stream from the air inlet 14, the operation proceeds smoothly for a long time or intermittently without charring on inside of the water-bearing raw material supply pipe or in the atomizing nozzle. For changing the water-bearing raw martial supply pipe and spray nozzle in accordance with kinds of raw material, the work is done easily only by drawing upward the water-bearing raw material supply pipe and spray nozzle.

Figure 3:
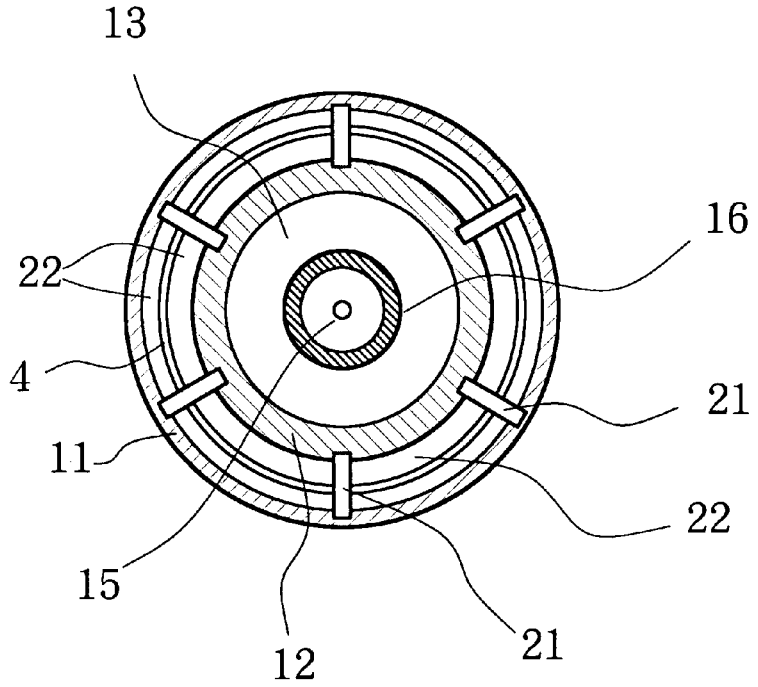
FIG. 3 is a horizontal section along I—I of the combustor shown by FIG. 2.

Since pulse combustion frequencies are lowered in a large capacity combustor having a large volume concentric ring form combustion chamber, as shown by FIG. 3 indicating sectional view along I—I of FIG. 2, the partition walls 21 dividing the concentric ring form combustion chamber into a plurality of divided chambers 22 having a smaller volume are provided, and an ignition means is disposed for each divided combustion chamber. As the result of that the combustion chamber is divided into a plurality of small volume divided chambers 22, the combustion gas can maintain the high frequency and retain the large volume as a whole. Each combustion chamber (divided chamber) is preferably divided to have combustion capacity of around scores ten thousand—scores hundred thousand kcal/Hr. The partition walls 21 are preferably disposed to divide evenly the combustion chamber 3 along the circumference so as each divided combustion chamber 22 becomes analogous. When the partition wall 21 is detachable with respect to the combustion chamber 3, conversion of the pulse combustor to combustors having different frequencies can be done easily upon request. By providing inserting slots at appropriate portions of the outer cylinder 11 and inner cylinder 12, the partition wall 21 can be installed and detached easily. When twelve inserting slots are provided under 30 degree pitch, the number of combustion chambers to be disposed can be varied in six kinds as 1, 2, 3, 4, 6 and 12 chambers, and pulse combustor gases having respectively different frequencies can be generated.

By dividing not only the combustion chamber but also the combustion air/fuel mixed gas supply chamber as well as the mixed gas supply slit into a plurality of divided chambers, and further by making arrangements for the fuel/combustion air mixed gas to be supplied or stopped independently for each divided combustion chamber, it is possible to operate the combustor under conditions that one or a plurality of divided combustion chambers (divided chamber 22) are closed. According to the operation, controlling ranges of the combustion capacity can be extended (1:2 for small combustors; 1:8 for large combustors).

Such ignition means 41 as an electric sparking plug disposed in the combustion chamber damages quickly due to the exposure to high temperatures. The ignition means is necessary only at the initial stage of operation and becomes unnecessary after the ignition for ordinary combustion or after reddening of the combustion chamber walls for pulse combustion, and its constant exposure to unnecessarily high temperatures is unfavorable. The ignition means 41 can keep a long life when the ignition means is arranged in a pilot combustion chamber 23 disposed near inlet of the combustion chamber as shown by FIG. 2, so as to be cooled by the cold fuel/air mixed gas flowing from the supply chamber 8 through a pilot combustion fuel/air mixed gas inlet hole 24 disposed at upper portion of the pilot combustion chamber.

Figure 4:
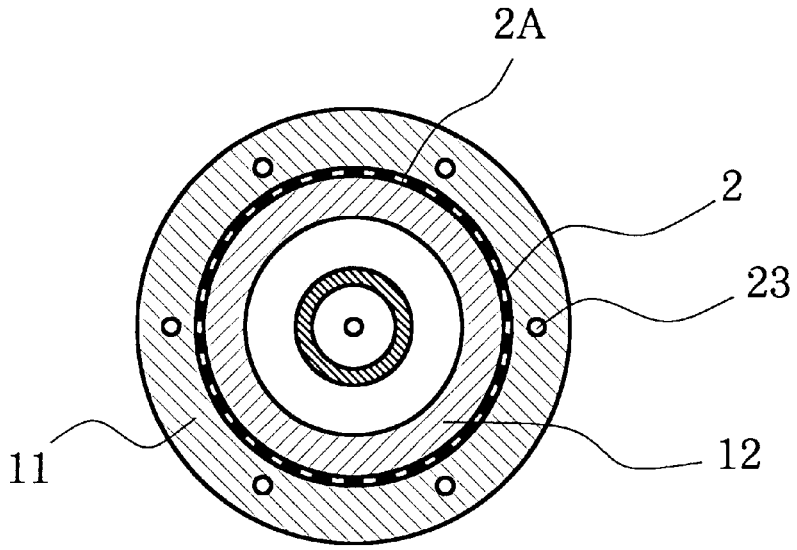
FIG. 4 is a horizontal section along II—II of the combustor shown by FIG. 2.

The mix gas having a specified supply air amount ratio is charged into the combustion chamber 3 from the concentric ring form fuel and combustion air supply chamber 8 through the slit 2, and the mixed gas is desirous of being supplied straightly without turning around into the combustion chamber from standpoint of improved combustion efficiencies. When the narrow concentric ring form mixed gas supply slit is divided into a number of narrow lengthy slits 2A (white portion) as shown by FIG. 4 indicating sectional view along II—II of FIG. 2, the mixed gas is ejected straightly through the narrow lengthy slit 2A into the combustion chamber 3.

The concentric ring form combustion chamber according to the present invention does not necessarily have the outer and inner circumferences of geometrically circular but may be formed polygonally by assembling trapezoidal form combustion chambers.

Figure 5:
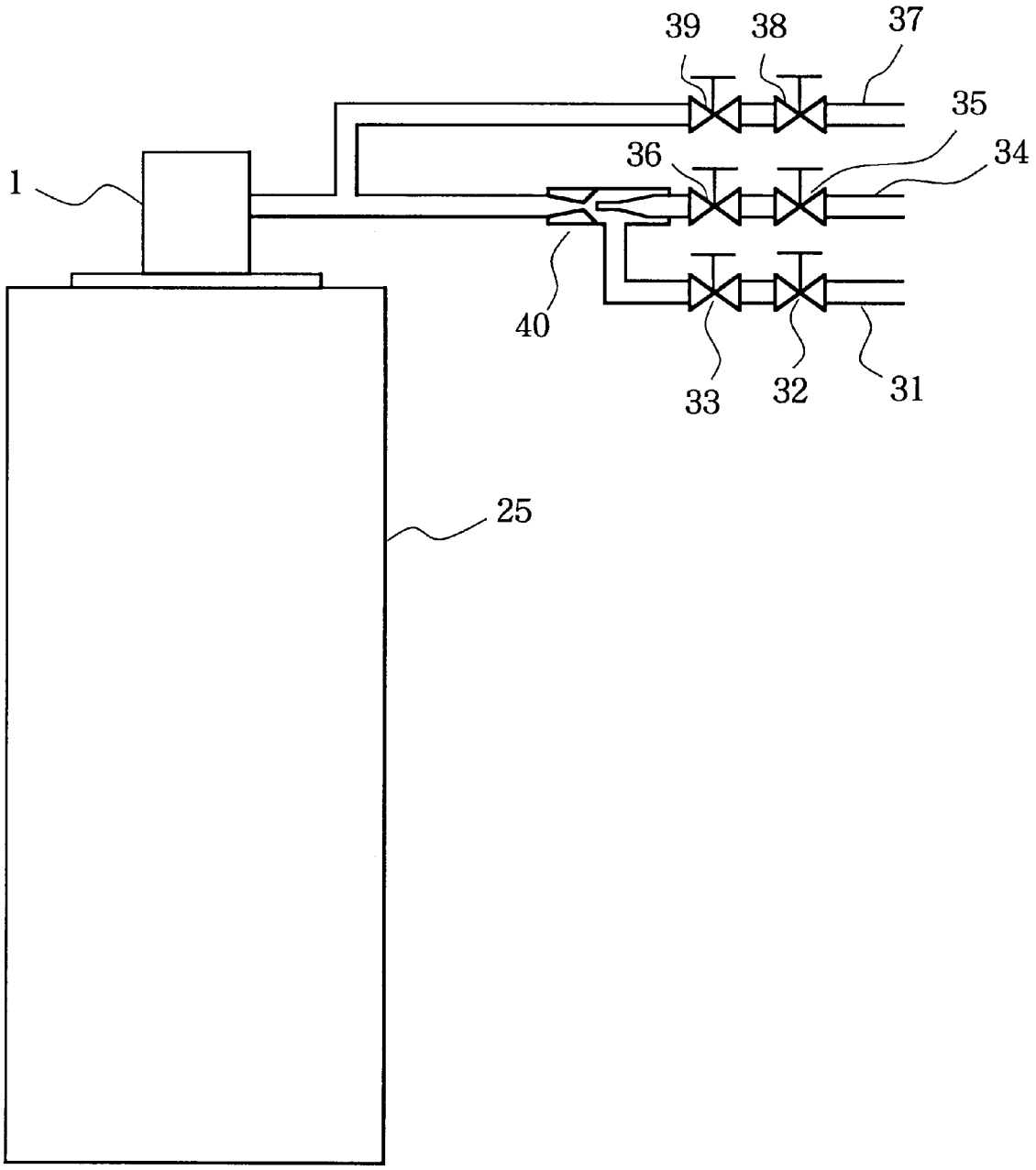
FIG. 5 is a drawing for explaining supply methods of combustion air and fuel for the combustor shown by FIG. 2.
Figure 6:
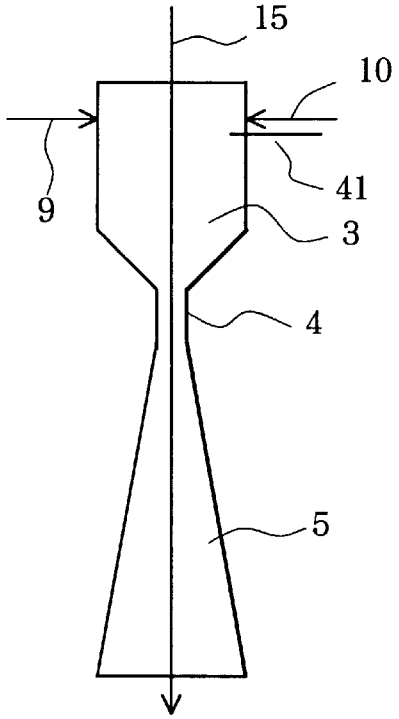
FIG. 6 is a drawing for showing a conventional pulse combustor and disposition of a water-bearing raw material supply pipe.
Figure 7:
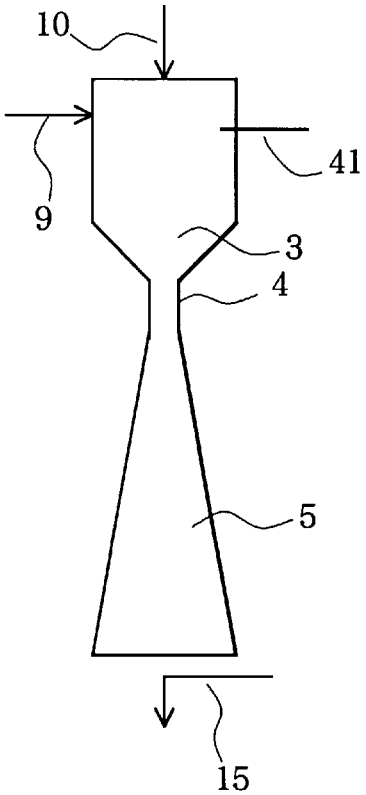
FIG. 7 is a drawing for showing a conventional pulse combustor and different disposition of a water-bearing raw material supply pipe.

Charging methods of fuel and combustion air for the present combustor to enable switching from ordinary combustion to pulse combustion or from pulse combustion to ordinary combustion will be explained by use of FIG. 5. The fuel gas is supplied to the fuel gas-air mixer 40 through the piping 31, switching valve 32 and adjusting valve 33. Air necessary for ordinary combustion (supply air amount ratio of below 0.7, usually of 0.4–0.6) is supplied to the fuel gas-air mixer 40 through the piping 34, switching valve 35 and adjusting valve 36, mixed with the fuel gas from the adjusting valve 33, and then charged to the combustor 1. When the fuel gas adjusting valve 33 is settled in advance at a specified fuel gas flow rate and the ordinary combustion air adjusting valve 36 is settled at a specified air flow rate, it is possible to supply or shut off the mixed gas for ordinary combustion by the combustor 1 only by switching of the valves 32 and 35. Since the mixed gas supplied from the fuel gas-air mixer 40 to the combustor 1 has a supply air amount ratio of smaller than the ratio necessary for pulse combustion (above 0.7, usually 0.8–1.5), the shortage of air (additional air for pulse combustion) is supplied through the piping 37, switch valve 38 and adjusting valve 39 to be joined to the mixed gas from the fuel gas-air mixer 40. When the adjusting valve 39 for additional air for pulse combustion is adjusted in advance to a specified air flow rate, switching between the ordinary combustion and pulse combustion is achieved only by operation of the switching valve 38. Supply pressure of the fuel gas can be reduced by use of an ejector for the fuel gas-air mixer 40, and the supply pressure of ordinary town gas (280 mmAq.) is enough for use. Air pressure for primary combustion is satisfied by supply pressure of ordinary high-pressure turboblowers (below 1500 mmAq.).

Various embodiments mentioned above can be employed selectively, and no need for their simultaneous practices.

Since the concentric ring form combustor can be installed in a hot blast chamber at top portion of spray dryer, portions to be disposed outside area for ordinary LPG burners are eliminated to be advantageous for the space and cost.

The present combustor can be used not only as an ordinary combustion gas generator without making noise but also as a large capacity high frequency pulse combustion gas generator, which can widen the narrow combustion range of conventional pulse combustors, and adaptable to such wide angle liquid atomizers as pressurized atomizing nozzles and rotary atomizers heretofore recognized as impossible, and makes it especially suitable for installation in pray dryers.

What is claimed is:

1. A dual-purpose combustor for ordinary combustion and pulse combustion comprising:

a concentric narrow ring form fuel/combustion air mixed gas supply slit having an inlet end and an exit end, a concentric wider ring form combustion chamber having an inlet end, said chamber inlet end being connected with the exit end of said fuel/combustion air mixed gas supply slit, and having an ignition means and a narrow outlet portion, a concentric narrow ring form exhaust gas chamber having an inlet end, said exhaust gas chamber inlet end being connected with the narrow outlet portion of said combustion chamber, a concentric wider ring form upper secondary combustion chamber having an inlet end, said secondary combustion chamber inlet end being connected with said exit end of said exhaust gas chamber, a cylindrical form lower secondary combustion chamber having the same diameter with the outer diameter of the concentric ring form upper secondary combustion chamber and connected with an exit end of said upper secondary combustion chamber, and a cylindrical cavity formed at the central portion of the concentric ring form fuel/combustion air mixed gas supply slit, the combustion chamber, the exhaust gas chamber and the upper secondary combustion chamber.

2. A dual-purpose combustor for ordinary combustion and pulse combustion according to claim 1, wherein said combustor comprises a concentric ring form fuel and combustion air supply chamber or a fuel/combustion air mixed gas supply chamber disposed at upper portion of the concentric ring form fuel/combustion air mixed gas supply slit providing for the fuel/combustion air or the fuel/combustion air mixed gas to be supplied to the inlet end of the slit.

3. A dual-purpose combustor for ordinary combustion and pulse combustion according to claim 1, wherein said ring form combustion chamber is provided with partition walls for separating the combustion chamber into a plurality of sections, and an ignition means is disposed at each separated sectional combustion chamber.

4. A dual-purpose combustor for ordinary combustion and pulse combustion according to claim 3, wherein said partition walls for separating the combustion chamber into a plurality of sections are detachable.

5. A dual-purpose combustor for ordinary combustion and pulse combustion according to claim 1, wherein a water-bearing raw material supply pipe or a water-bearing raw material supply pipe having a protecting tube is disposed along the center axis of said cylindrical cavity to spray the water-bearing raw material into the fuel/combustion air mixed gas.

6. A dual-purpose combustor for ordinary combustion and pulse combustion according to claim 1, wherein there are disposed an air inlet at upper portion and an air straightening honeycomb at bottom portion of the cylindrical cavity and a water-bearing raw material supply pipe accompanied with a protecting tube disposed along the center axis to spray the water-bearing raw material into the fuel/combustion air mixed gas.

7. A dual-purpose combustor for ordinary combustion and pulse combustion according to claim 1, wherein the ring form fuel/combustion air mixed gas supply slit is divided into a plurality of narrow vertical slits.

* * * * *